US009272798B2

(12) United States Patent
Lang

(10) Patent No.: US 9,272,798 B2
(45) Date of Patent: Mar. 1, 2016

(54) COMPLETE CUTTING STATION AND METHOD FOR SEPARATING PACKAGING UNITS

(75) Inventor: Michael Lang, Buching (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 213 days.

(21) Appl. No.: 13/527,106

(22) Filed: Jun. 19, 2012

(65) Prior Publication Data

US 2012/0318115 A1 Dec. 20, 2012

(30) Foreign Application Priority Data

Jun. 20, 2011 (DE) ..... 10 2011 104823

(51) Int. Cl.

| | |
|---|---|
| ***B26D 7/06*** | (2006.01) |
| ***B65B 9/04*** | (2006.01) |
| ***B65B 35/38*** | (2006.01) |
| ***B65B 61/06*** | (2006.01) |
| ***B65B 5/10*** | (2006.01) |

(52) U.S. Cl.

CPC . *B65B 9/04* (2013.01); *B65B 5/105* (2013.01); *B65B 35/38* (2013.01); *B65B 61/065* (2013.01); *Y10T 83/6667* (2015.04)

(58) Field of Classification Search

CPC ..... B65B 9/04; B65B 5/105; B65B 35/38; B65B 61/065; Y10T 83/6667

USPC ..... 83/100, 152; 53/329.5, 247, 552, 532, 53/540, 543

See application file for complete search history.

(56) References Cited

U.S. PATENT DOCUMENTS

| | | | | |
|---|---|---|---|---|
| 3,168,204 | A * | 2/1965 | Voullaire | B65B 25/046 414/791.7 |
| 3,735,654 | A * | 5/1973 | Jurasek | 83/100 |
| 3,848,492 | A * | 11/1974 | Vetter | 83/99 |
| 4,043,234 | A * | 8/1977 | Godin et al. | 83/40 |
| 5,079,903 | A * | 1/1992 | Hakansson | 53/473 |
| 5,566,601 | A * | 10/1996 | Mueller et al. | 83/123 |
| 5,611,193 | A * | 3/1997 | Farrelly | 53/475 |
| 5,743,068 | A * | 4/1998 | Madariaga | 53/247 |
| 5,943,842 | A * | 8/1999 | de Koning et al. | 53/247 |
| 6,003,286 | A * | 12/1999 | Goodman | 53/537 |
| 6,209,293 | B1 * | 4/2001 | Powers | 53/475 |

(Continued)

FOREIGN PATENT DOCUMENTS

| | | |
|---|---|---|
| DE | 8809060 U1 | 9/1989 |
| DE | 19733824 A1 | 2/1999 |

(Continued)

*Primary Examiner* — Ghassem Alie
*Assistant Examiner* — Bharat C Patel
(74) *Attorney, Agent, or Firm* — Husch Blackwell LLP

(57) ABSTRACT

A complete cutting station for separatingly cutting out packaging units from a film composite, the cutting station having a movable complete cutting tool configured for severing the film composite. The complete cutting station further comprises a conveying system having a plurality of conveyor elements for conveying a respective separated packaging unit, wherein each conveyor element in turn comprises a head portion for engaging with a respective packaging unit. The head portions of the conveyor elements may be movable between a first position in which the gripped packaging units are at a first distance relative to each other, and a second position in which the packaging units are at a second, smaller distance from each other or at least partially overlap in at least one spatial direction.

8 Claims, 4 Drawing Sheets

(56) References Cited

U.S. PATENT DOCUMENTS

| | | | | |
|---|---|---|---|---|
| 7,107,742 | B2 * | 9/2006 | Blanc | 53/537 |
| 7,467,504 | B2 * | 12/2008 | Mate et al. | 53/537 |
| 7,690,706 | B2 * | 4/2010 | Wild | B65G 47/907 198/468.3 |
| 8,534,727 | B2 * | 9/2013 | Weclawski | B65G 47/918 198/468.3 |
| 2006/0128281 | A1 * | 6/2006 | Bando | 451/70 |
| 2009/0035435 | A1 * | 2/2009 | Stanojevic | 426/518 |

FOREIGN PATENT DOCUMENTS

| | | | |
|---|---|---|---|
| DE | 102009031516 | A1 | 1/2011 |
| EP | 2033764 | A1 | 3/2009 |

* cited by examiner

COMPLETE CUTTING STATION AND METHOD FOR SEPARATING PACKAGING UNITS

CROSS-REFERENCE TO RELATED APPLICATION

This application claims priority to German Application Number 102011104823.9 filed Jun. 20, 2011 to Michael Lang entitled "Complete Cutting Station and Method for Separating Packaging Units," currently pending, the entire disclosure of which is incorporated herein by reference.

TECHNICAL FIELD

The invention relates to a complete cutting station and to a method for separating packaging units which were produced in a common film composite.

BACKGROUND

Respective complete cutting stations and methods are known in practice. They are widely used in packaging machines in which packaging units are produced from or with a plastic film, for example, in thermo-forming packaging machines or tray sealers. For reasons of efficiency, packaging units are frequently produced in multiple lanes and multiple rows, i.e., several packaging units are produced both in a row as well as side by side in one operation cycle. These packaging units are attached to each other in a film composite (i.e. in a common foil) because at least one film extends continuously across all packaging units and connects these packaging units to each other. In thermo-forming packaging machines, this is the lower film into which packaging trays are thermoformed. Both in thermo-forming packaging machines as well as in tray sealers, the packaging units are connected to each other by means of a top or lid film which is simultaneously sealed onto a plurality of packaging trays.

There are basically two different variants of how to separate such packaging units connected to each other in a film composite. In the first variant, a longitudinal cutting device and a transverse cutting device are provided one behind the other in the conveying direction i.e. apart from each other. The transverse cuts between adjacent rows of packaging are usually first applied, i.e. the film composite is severed between adjacent rows. Subsequently, the longitudinal cutting device separates the packaging units of the respective lanes.

In the second variant, to which also the present invention relates, packaging units are cut or punched out from the film composite in a single process step. This is done by means of a complete cutting tool.

It can be problematic in using a complete cutting tool in that the packaging units can lose their orientation after separation, such as when falling onto a discharge conveyor. This can make subsequent process steps for the packaging units difficult.

SUMMARY OF THE INVENTION

It is the object of the invention to improve the separation of packaging units from a common film composite with structurally simple means with regard to facilitated subsequent handling of the packaging units.

This object is satisfied by a complete cutting station and a method for separating the packaging units, respectively.

The complete cutting station according to the invention comprises a conveying system which is provided with a respective head portion for gripping on to a packaging unit. In the invention, the head portions of at least one, but possibly of all conveying elements are movable between a first position in which packaging units that they gripped are at a first distance to each other defined by the film composite, and a second position in which the packaging units are at a second, smaller distance from each other. This second, smaller distance can even be a "negative distance", meaning that the packaging units at least in one spatial direction at least partially overlap.

The complete cutting station according to the invention provides various advantages regarding the handling of the packaging units. The conveying system already ensures that the packaging units do not lose their position and orientation during separation. This is because during separation, the packaging units can be held by the head portions of the conveyor elements and be fixed in their position. In addition, the conveying system enables transfer of the separated packaging units from the complete cutting tool, for example, to a subsequent packing station, where a group of packaging units is placed into a common outer packaging unit. But above all, the conveying system in the complete cutting station according to the invention allows for the distance of the packaging units to be reduced or even an overlap between the packaging units is created by means of the conveying system after separation of the packaging units. This makes it possible to accommodate more packaging units in an outer packaging unit of a given size, or a given number of packaging units, to use smaller outer packaging units. This in turn makes subsequent logistics processes more process-reliable, simpler and less expensive. Alternatively, the packaging units could be placed not in an outer packaging unit, but on a discharge belt or the like—here again with the advantage mentioned of saving space and of simplifying logistics.

Preferably, the conveyor elements are translationally movable and/or pivotable in order to reduce the distance between adjacent packaging units. Both variants are relatively easy to design and provide secure and precise positioning of the packaging units when reducing the distance to each other.

It is particularly favorable where, in the second position of the head portions of the conveyor elements, there is a partial overlap in two spatial directions of the packaging units gripped by the head portions. A particularly large amount of space is saved when inserting the packaging units into a common packaging unit.

Conveniently, the conveyor elements are movable between a retracted and an extended position. This allows them to convey packaging units, that are gripped by the head portions, out of the complete cutting tool. The motion between a retracted and an extended position can be either independent of the motion of the conveyor elements reducing the distance between the packaging units, or the motion between the retracted and extended positions of the conveyor elements can be superimposed or occur simultaneously with the motion reducing the distance between adjacent conveyor elements.

When the head portions of the conveyor elements are in the retracted position between cutting edges of the complete cutting tool, then the complete cutting station can be designed in an extremely compact manner.

The complete cutting tool can, during operation of the complete cutting station, be positioned above the film composite. This has an advantage in that the space below the separated packaging units remains free, and is thus not occupied in particular by a complete cutting tool. This allows for outer packaging units or a discharge belt to be placed directly underneath the packaging units to be separated, further facilitating the handling of the packaging units.

In one embodiment, the complete cutting tool comprises a bridge connecting several cutting edges of the tool. Each cutting edge can be provided for separating or punching out a single package. The connection of the cutting edges, by means of a bridge, increases the stability of the cutting edges and thus ensures even more precise, simultaneous separation of several packaging units.

Beyond that, these bridges offer the option of to have the conveyor elements of the conveying system mounted on them in a pivotal and/or translationally movable manner. This could for example be achieved by pivot bearings or rails.

In a preferred variant of the invention, the conveyor elements are vacuum grippers and the head portions are suction heads of these vacuum grippers. A vacuum pump can be used to apply a vacuum to the suction heads in order to be able to fix packaging units there.

The invention also relates to a packaging machine with a complete cutting station of the kind described above. The packaging machine can in particular be a thermo-forming packaging machine or a tray sealer.

Furthermore, the invention also relates to a method for separating packaging units which were produced in a common film, i.e. a film composite. In this method, the packaging units still being connected in the film composite are gripped by means of a respective head portion of a conveyor element, the packaging units are separated by means of a complete cutting tool separating the film composite, and the head portions of the conveyor elements each gripping a packaging unit are subsequently moved such that the distance between adjacent packaging units is reduced and/or that adjacent packaging units overlap at least partially. This method provides the same advantages as explained above with respect to the complete cutting station according to the invention.

To enable simple yet accurate positioning of the packaging units, the conveyor elements can pivot and/or move translationally in order to reduce the distances between adjacent packaging units.

It would also be conceivable that some conveyor elements initially move in a direction perpendicular to a plane of the film composite, before the distances between the head portions of the conveyor elements are reduced. This makes it possible to initially bring a few packaging units to a higher or lower plane than adjacent packaging units. This can facilitate overlapping of the packaging units, since collision of the edges of adjacent packaging units at the same height is avoided. It is in particular conceivable, that along a row and/or a track of packaging units, every other packaging unit is in this manner vertically to the plane of the film composite initially brought into another plane before the distances between adjacent packaging units is reduced or the packaging units are overlapped.

Particularly simple fixing and releasing of the packaging units can be enabled by having by the head portions of the conveyor elements grip the packaging units by means of suction.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are in the figures designated throughout with the same reference numerals.

DETAILED DESCRIPTION OF THE INVENTION

Figure 1:
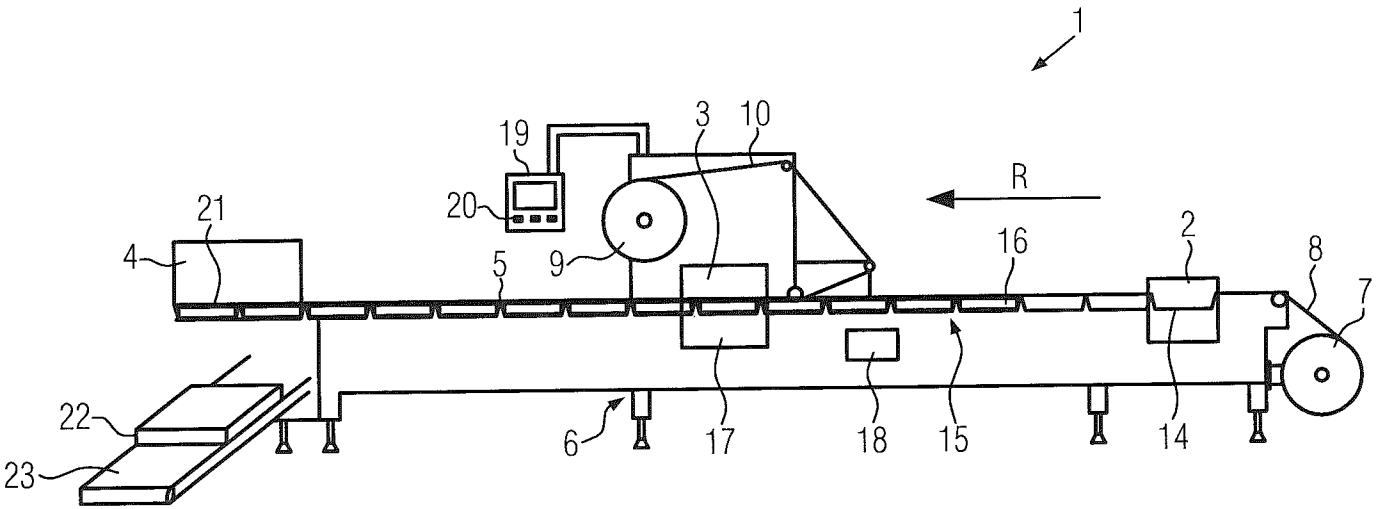
FIG. 1 shows a schematic view of a packaging machine in the form of a thermo-forming packaging machine in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic view of a packaging machine 1 according to the invention in the form of a thermo-forming packaging machine. This thermo-forming packaging machine 1 comprises a forming station 2, a sealing station 3, and a complete cutting station 4 according to the invention, which are arranged in this sequence in a direction of processing R on a machine frame 6. On the input side, the machine frame 6 has a supply roller 7 disposed on it, from which a film 8 is drawn off. In the region of the sealing station 3, a material storage 9 is provided, from which a top film 10 is drawn off.

Furthermore, the packaging machine 1 comprises a supply device or feed device (not shown) which grips the film 8 in order to transport it with every main processing cycle in the direction of processing R. The supply device can for instance be conveyor chains disposed at both sides of the film 8

In the illustrated embodiment, the forming station 2 is formed as a thermo-forming station, in which trays 14 are formed in the film 8 by thermo-forming. In this, the forming station 2 may be designed such that several trays can be formed next to one another in the direction perpendicular to the direction of processing R. Following the forming station 2 in the direction of processing R, a filling stretch or loading stretch 15 is provided, in which the trays 14 formed in the film 8 are manually or automatically filled with a product 16.

The sealing station 3 has a sealable chamber 17 in which the atmosphere in the packaging trays 14 prior to sealing can, for example by flushing with a gas, be replaced with an exchange gas or a gas mixture. Alternatively, the packaging trays 14 in the sealable chamber 17 can be evacuated.

At the complete cutting station 4, the packaging units produced together in one processing cycle of the packaging machine 1 are simultaneously separated. They are simultaneously cut out from the film composite 5. This film composite 5 results from the lower film 8 and/or the top film 10, by means of which all packaging units of the group of packaging units are connected. In the complete cutting station, every packaging unit is cut or punched out from the film composite 5 in a single process step.

The packaging machine 1 further comprises a controller 18. It has the duty of controlling and monitoring the processes running in the packaging machine 1. A display device 19 with controls elements 20 is used for visualizing or influencing, respectively, the processes in the packaging machine 1, or by an operator, respectively.

The general mode of operation of the packaging machine 1 is described briefly below.

The lower film 8 is drawn off from the feed roller 7 and transported through a supply device into the forming station 2. In the forming station 2, trays 14 are formed in the film 8 by thermo-forming. The trays 14 are together with the surrounding area of the film 8 further transported in one main processing cycle to the filling stretch or loading stretch 15 in which they are filled with the product 16.

Then, the filled trays 14 together with the surrounding area of the film 8 are in a further main processing cycle transported by the supply device into the sealing station 3. The top film 10 is, after a sealing process to the film 8, further transported with the feeding motion of the film 8. In this, the top film 10 is drawn off from the material storage 9. Sealing the top film 10 onto the packaging trays 14 results in closed packaging units 21, which initially continue to remain connected in a common film composite 5. This film composite, as explained, is formed from the lower film 8 and the top film 10. The packaging units 21 are finally separated in the complete cutting station 4.

In the region of the complete cutting station 4, outer packaging units 22 can be provided, for example cardboard boxes, for receiving separated packaging units 21. FIG. 1 shows a variant in which the outer packaging units 22 are by means of a conveyor element, for example, a conveyor belt 23, brought to a position below the complete cutting station 4. There, each outer packaging unit 22 can from the top be filled by means of one or several groups of respectively simultaneously produced and separated packaging units 21. If the outer packaging unit 22 is filled completely, it is removed by means of the conveyor belt 23 and replaced with a new outer packaging unit 22.

Figure 2:
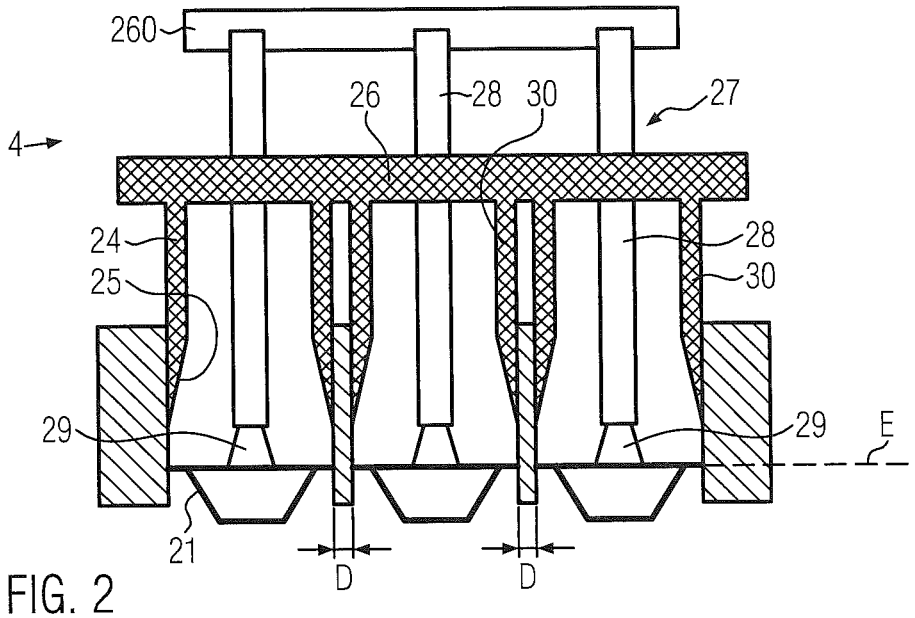
FIG. 2 is a sectional view of the complete cutting station shown in FIG. 7 cut along the line II-II showing the head portions of the conveyor elements disposed below the cutting edges in accordance with one embodiment of the present invention.

FIG. 2 shows a schematic representation of the major components of an embodiment of a complete cutting station 4 according to the invention. This complete cutting station 4 comprises a complete cutting tool 24, which in turn comprises several cutting edges 25. Each cutting edge 25 has a shape corresponding to the outer contour of the packaging unit 21 to be produced, i.e. each cutting edge 25 can in one single process step separate a packing unit 21 from the film composite 5. The outer contour of the packaging unit 21 or the contour of the cutting edge 25, respectively, is virtually arbitrary. For example, they can be oval, rectangular or square with or without rounded corners, polygonal, circular, etc. The cutting edges 25 are facing downwards, as the complete cutting tool 24 with the complete cutting station 4 according to the invention is located above the film composite 5.

The cutting edges 25 are mounted to a bridge 26 that connects all the cutting edges 25 of the tool 24 with each other. The bridge 26 can by means a suitable drive, for example a servomotor, be moved in the vertical direction relative to the film composite 5, so that the cutting edges 25 severe the film composite 5 and thus separate the packaging units 21. Adjacent packaging units during separation, as shown in FIG. 2, have a distance D to each other, which is defined by the position of the packaging units 21 in the film composite 25 or by the arrangement of the cutting edges 25 of the tool 24.

The complete cutting station 4 also comprises a gripper or conveying system 27. The conveying system 27 comprises a plurality of movable conveyor elements 28, each of which comprises a head portion 29 to be able to fix each individual packaging unit 21 to the conveyor element 28. Preferably, the conveyor elements 28 are vacuum grippers and the head portions 29 are respective suction heads on these vacuum grippers. If a vacuum is applied to them by a suitable vacuum source, packaging units 21 are fixed to the suction heads 29 applied to them.

Figure 7:
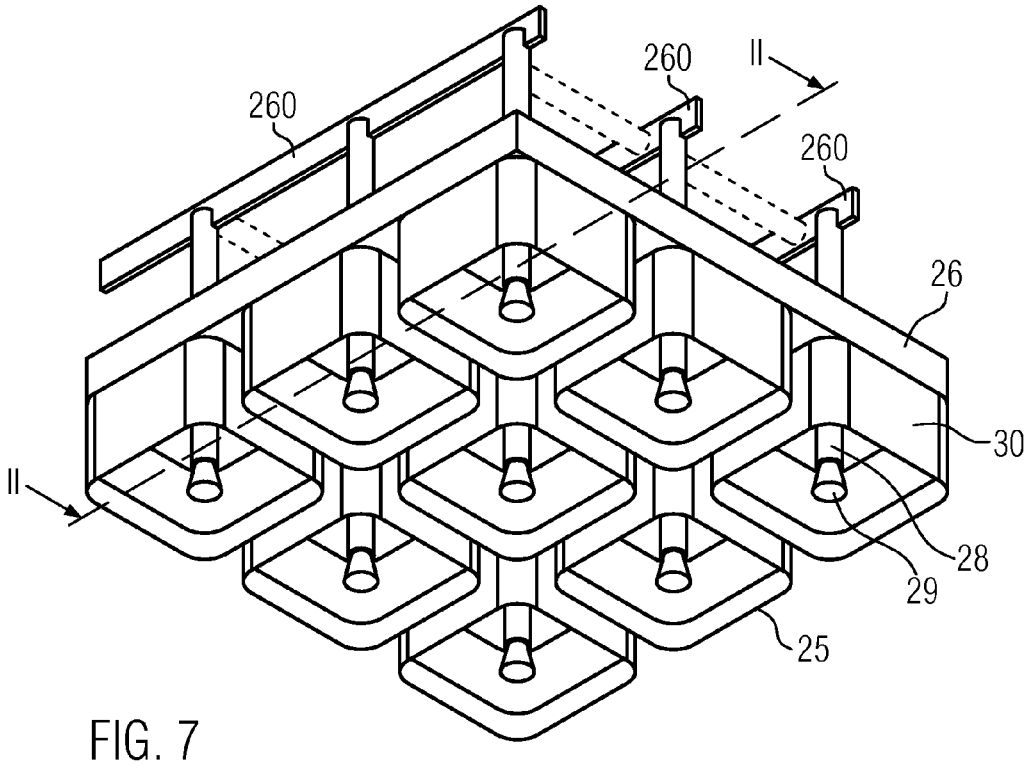
FIG. 7 shows a bottom perspective view of a complete cutting tool in accordance with one embodiment of the present invention.
Figure 8:
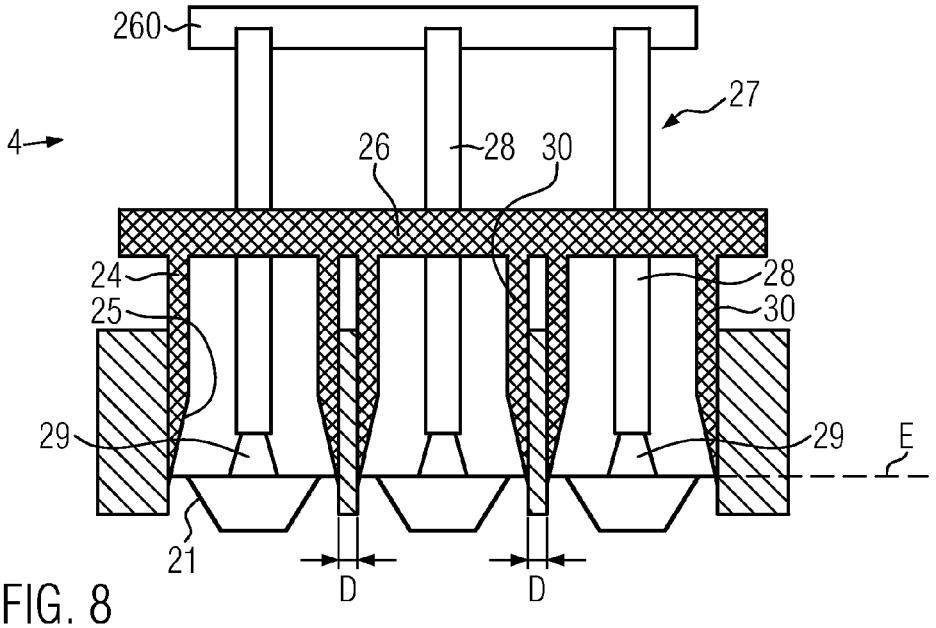
FIG. 8 is a sectional view of the complete cutting station shown in FIG. 7 cut along the line II-II showing the head portions of the conveyor elements in a retracted position and disposed between the cutting edges in accordance with one embodiment of the present invention.

As shown in FIGS. 7 and 8, the head portion 29 of each conveyor element 28 has such external dimensions that it can be located fully within the limits of a contour for a particular packaging unit defined by a cutting edge 25, i.e. does not interfere with the cutting edge 25. The conveyor elements 28 themselves are essentially rod-shaped and extend in the vertical direction. At its lower end, a conveyor element 28 carries its head portion 29 to which it can fix a packaging unit 21. In the interior of the rod-like conveyor element 28, there can be a pneumatic line for applying a negative pressure at the head portion 29.

The conveyor elements 28 are in the illustrated embodiment supported at a gripper bridge 260 of the complete cutting station 4. They are in particular there supported such that they can move in a vertical direction in relation to the complete cutting tool 24, namely, between a retracted position in which the head portions 29 are located between the cutting edges 25 (see FIGS. 7 and 8), and an extended downward position. By being attached to the gripper bridge 260, the vertical or stroke motion of the conveyor elements 28 is coupled. The vertical motion of the conveyor elements 28 is at least sectionally independent of the vertical motion of the complete cutting tool 24. The height of the cutting blades 30 comprising the cutting edges 25, i.e. the distance from the lower end of the cutting edges 25 to the bridge 26 is so large that the head portions 29 of the conveyor elements 28 can be retracted between the cutting blades 30 as shown in FIGS. 7 and 8.

In addition to the vertical motion between a retracted and an extended position, the conveyor elements 28 can also perform a pivoting motion and/or a lateral translation motion.

In order to be able to perform this additional motion, the conveyor elements 28 are provided with suitable actuators or motors.

Figure 3:
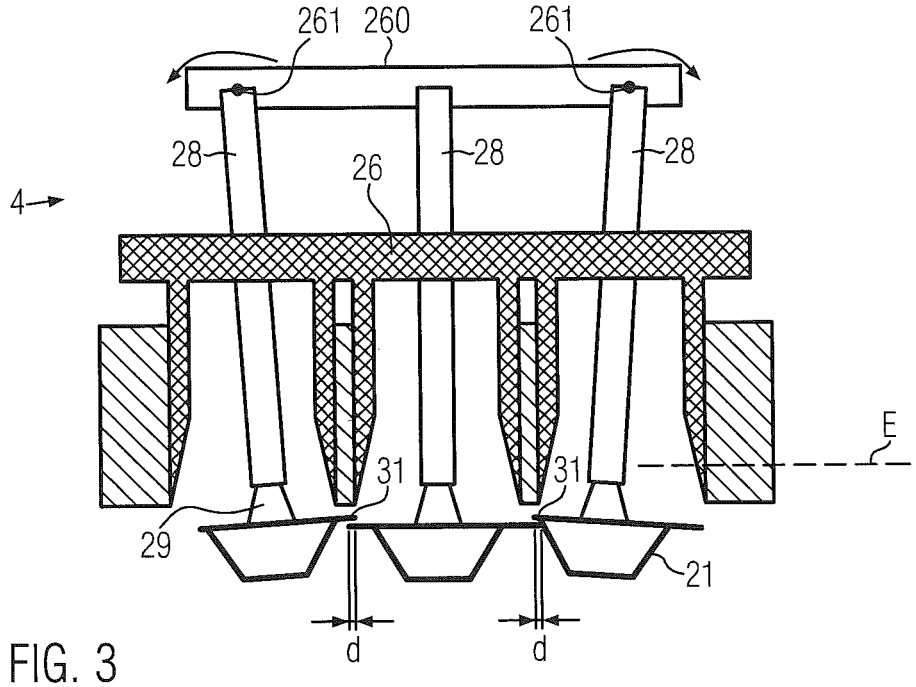
FIG. 3 is a sectional view of the complete cutting station shown in FIG. 7 cut along the line II-II showing the head portions of the conveyor elements disposed below the cutting edges and some of the conveyor elements being rotated to move some of the packaging units to vertically overlap in accordance with one embodiment of the present invention.

FIG. 3 shows a variant of the complete cutting station 4, in which at least the outer conveyor elements 28 of the conveying system 27 are pivotably supported on the gripper bridge 260 by pivot joints 261. This allows them to move from the retracted initial position shown in FIG. 2 to the extended position shown in FIG. 3. Subsequently, the two outer conveyor elements 28 are pivoted (see the two arrows in FIG. 3) such that their head portions 29 approach the head portion 29 of the center conveyor element 28. This causes two things: Firstly, the two outer packaging units 21 take a slanted position due to the pivoting motion of the conveyor elements 28 so that their edges 31 are located above the edge 31 of the center packaging unit 21. Secondly, the distance D between adjacent packaging units 21 is reduced by the pivoting motion 28. In the position shown in FIG. 3, the new distance d between adjacent packaging units 21 is even negative, i.e. the packaging units 21 overlap each other at their edges 31.

Figure 4:
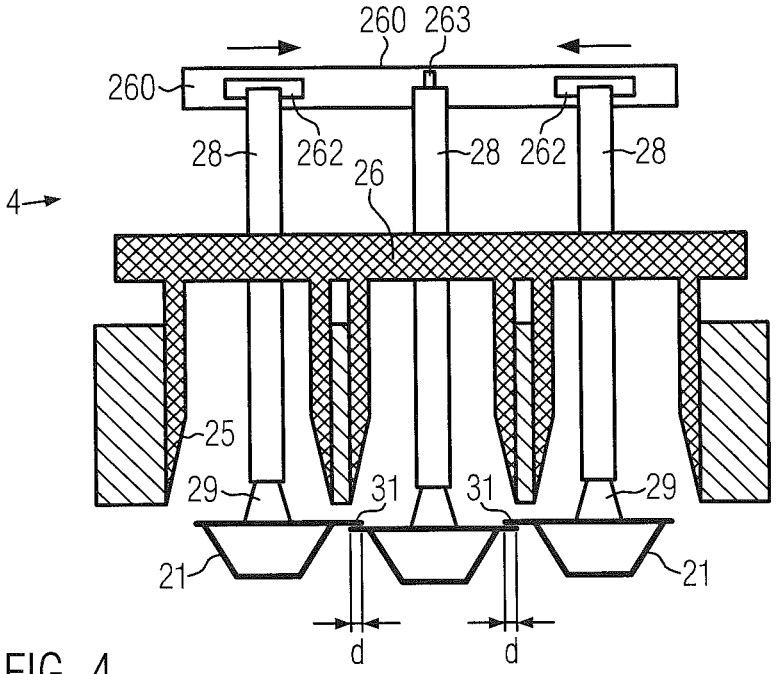
FIG. 4 is a sectional view of the complete cutting station shown in FIG. 7 cut along the line II-II showing the head portions of the conveyor elements disposed below the cutting edges and some of the conveyor elements being translated to move the packaging units to overlap vertically in a horizontal direction in accordance with one embodiment of the present invention.

FIG. 4 shows another variant of a complete cutting station 4 according to the invention. In this variant, the conveyor elements 28 of the conveying system 27 are mounted on a gripper bridge 260 and movable in the vertical direction relative to the complete cutting tool 24 between a retracted and an extended position. FIG. 4 shows the conveyor elements 28 in the extended position. In addition, the conveyor elements 28, however, are now also movable in the lateral, horizontal direction transversely relative to each other, as again is shown by the two arrows in FIG. 4. This is true at least for the two outer conveyor elements 28. They can, after extension of the conveyor elements 28, move in a horizontal direction along the horizontal guides 262 towards the center conveyor element 28. In this manner, the distance D between adjacent packaging units 21 is reduced. As shown in FIG. 4, the new distance d can even be negative, i.e. adjacent packaging units 21 overlap each other. Conveniently, the medium conveyor element 28 is guided along a vertical guide 263 at the gripper bridge 260 further downward than the two outer conveyor elements 28, so that the edges 31 of adjacent packaging units 21 do not collide with each other.

Figure 5:
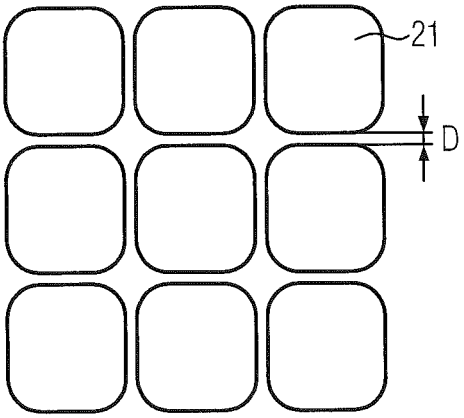
FIG. 5 shows a plan view of a group of packaging units during separation in accordance with one embodiment of the present invention.

FIG. 5 schematically shows a plan view of a group of new packaging units 21 which is produced in three rows and three lanes in a single processing cycle of the packaging machine 1. Adjacent packaging units 21 have a distance D to each other when they are separated from the common film composite 5.

Figure 6:
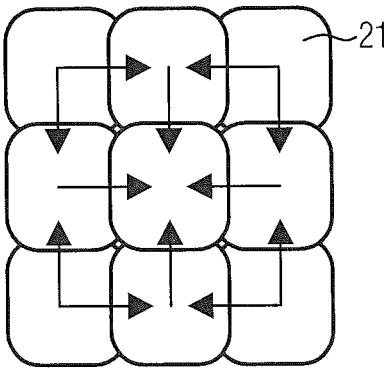
FIG. 6 shows a plan view of the packaging units shown in FIG. 5 after reduction of the distance of adjacent packaging units in accordance with one embodiment of the present invention.

FIG. 6 shows the same nine packaging units 21 after separation of the packaging units 21 and after decreasing the distance between the packaging units by means of the conveying system 27. The arrows in FIG. 6 indicate in which direction particular packaging units are moved towards each other. It can be seen that the distances D between adjacent packaging units 21 can be reduced in two horizontal spatial directions, until even an overlap between adjacent packaging units 21 occurs. The entire group of nine packaging units 21 is thus significantly more compact than the original situation shown in FIG. 5.

The following illustrates the sequence of the method according to the invention and the operation, respectively, of the packaging machine 1 according to the invention.

As already explained above, packaging units 21 are produced in the thermo-forming packaging machine 1, in that packaging trays 14 are sealed in the sealing station 3 with a top film 10. The packaging units 21 are attached to each other in a common film composite 5, which is located in a horizontal plane E (see FIG. 2) and is formed from the lower film 8 and the top film 10.

In a main processing cycle of the packaging machine 1, a group of n (for example 3×3) simultaneously produced packaging units 21 are conveyed into the complete cutting station 4. There, the conveying system 27 lowers its conveyor elements 28, until the head portions 29 of the conveyor elements 28 each engage with a packaging unit 21. By applying a negative pressure to the head portions 29, the packaging units 21 are fixed to the conveyor elements 28 so that the packaging units 21, also when being cut out from the film composite 5, initially maintain their positions relative to each other.

In the next step, the complete cutting tool 24 is lowered, so that the cutting edges 25 of the cutting knife 30 severe the film composite 5 and thus separate the packaging units 21 form each other in a single processing step. Subsequently, the conveyor elements 28 move in the vertical direction from their retracted to a downwardly extended position, see FIG. 3 or 4. The top side of the packaging units 21 is thus located below the plane E of the original film composite 5 and preferably below a lower edge of the complete cutting station 4.

Now, the distances between adjacent packaging units are reduced. This can be done either by pivoting at least some conveyor elements 28 (see FIG. 3) or by a translational movement 28 of certain conveyor elements 28 in the horizontal direction, see FIG. 4. For this, each second conveyor element 28 is lowered slightly further than the respective adjacent conveyor element 28 so that the edges 31 of adjacent packaging units 21 can push onto each other and an overlap between adjacent packaging units 21 arises (see FIGS. 3, 4 and 6).

The mutually overlapping packaging units 21 can now, if necessary, be further lowered and be placed in a common outer packaging unit 22 which is located below the complete cutting station 4. Once the packaging unit 22 is sufficiently filled, meaning contains a desired number of packaging units 21, it can be removed by the conveyor element 23. It is possible that the outer packaging unit 22 can contain only one or several layers of packaging units 21 one above the other.

Based on the embodiment illustrated, the complete cutting station 4 according to the invention and the method according to the invention can be modified in many ways. It is in particular conceivable that any number of packaging units in n tracks and/or m rows is produced simultaneously. The complete cutting tool 24 and the conveying system 27 should then be configured in order to be able to simultaneously separate the respective group of packaging units and convey it out of the complete cutting station 4.

What is claimed is:

1. A complete cutting station for separatingly cutting out packaging units from a film composite, said cutting station comprising:

a complete cutting tool disposed for vertical movement and configured for severing said film composite, said cutting tool comprising using a plurality of cutting edges disposed to separatingly cut out a plurality of packaging units from a film composite, each cutting edge defining an outer contour of one of said plurality of packaging units; and a conveying system having a plurality of conveyor elements for conveying a respective separated packaging unit, each said conveyor element comprising a head portion for engaging with a packaging unit, wherein said conveyor elements are disposed for vertical movement independent of said complete cutting tool and movable between a retracted and an extended position, and wherein each said head portion of said conveyor elements is located within the outer contour defined by one of said plurality of said cutting edges and laterally adjacent to the cutting edges in said retracted position;

wherein said head portions of at least some conveyor elements are movable between a first position in which packaging units that they engage are at a first distance to each other defined by said film composite, and a second position in which said packaging units are one of at a second smaller distance from each other or vertically overlap in at least one horizontal spatial direction; and wherein said conveyor elements are vacuum grippers, and said head portions are suction heads.

2. The complete cutting station according to claim 1, wherein at least some of said conveyor elements are translationally movable and/or pivotable for moving the respective head portion of said at least some of said conveyor elements between said first position and said second position.

3. The complete cutting station according to claim 1, wherein when each of said head portions of said plurality of conveyor elements are engaging said packaging units and at least some of said head portions are disposed in said second position of said respective head portions, at least some of said packaging units vertically overlap with at least two other adjacent packaging units.

4. The complete cutting station according to claim 1, wherein said complete cutting tool is disposed vertically above the film composite during operation of said complete cutting station.

5. The complete cutting station according to claim 1, wherein said complete cutting tool comprises a bridge connecting several cutting edges.

6. The complete cutting station according to claim 1, wherein at least some of said conveyor elements are mounted to a gripper bridge and disposed for one of pivotal or translational motion.

7. The complete cutting station according to claim 1, wherein said complete cutting station is a component in a packaging machine.

8. The complete cutting station according to claim 1 wherein said head portions hold and fix a position of said packaging units during separation of said packaging units from said film composite when said head portions are disposed in said first position.

* * * * *